US005582871A

United States Patent [19]

Silenius et al.

[11] Patent Number: 5,582,871

[45] **Date of Patent: *Dec. 10, 1996**

[54] METHOD FOR PRESERVING WOOD AGAINST UNDESIRABLE REACTIONS CAUSED BY MICROORGANISMS

[75] Inventors: Petri Silenius, Lohja; Liisa Viikari; Anne-Christine Ritschkoff, both of Helsinki, all of Finland

[73] Assignee: Kymmene Oy, Helsinki, Finland

[ * ] Notice: The term of this patent shall not extend beyond the expiration date of Pat. No. 5,538,670.

[21] Appl. No.: 338,562

[22] PCT Filed: Mar. 31, 1994

[86] PCT No.: PCT/FI94/00127

§ 371 Date: Nov. 21, 1994

§ 102(e) Date: Nov. 21, 1994

[87] PCT Pub. No.: WO94/22647

PCT Pub. Date: Oct. 13, 1994

[30] Foreign Application Priority Data

Apr. 2, 1993 [FI] Finland ..... 931505

[51] Int. Cl.[6] ..... B05D 3/02

[52] U.S. Cl. ..... 427/393; 427/297; 427/393.3; 427/393.4; 427/440; 252/380; 252/607

[58] Field of Search ..... 427/297, 393, 427/393.3, 393.4, 397, 440; 252/380, 607

[56] References Cited

U.S. PATENT DOCUMENTS

| | | | |
|---|---|---|---|
| 4,090,000 | 5/1978 | Hatcher | 427/393 |
| 4,382,105 | 5/1983 | Amundsen | 427/370 |

FOREIGN PATENT DOCUMENTS

WO91/00326 1/1991 WIPO .

WO93/08971 5/1993 WIPO .

OTHER PUBLICATIONS

Rao, et al., "A Non Conventional Method of Wood Preservation", *Journal of Archaeological Chemistry,* vol. 4, pp. 11–15 (1986).

*Chemical Abstracts,* vol. 108, No. 2, p. 89 (1988) (citing Rao, et al.).

*Primary Examiner*—Shrive Beck
*Assistant Examiner*—Brian K. Talbot
*Attorney, Agent, or Firm*—Hoffmann & Baron

[57] ABSTRACT

The present invention is related to a method for preserving wood against undesirable reactions caused by microorganisms. The invention also concerns wood preserved against molds, blue-stain fungi and rot fungi. According to the method, the wood being preserved is treated with a substance capable of inhibiting the growth of microorganisms, whereby said substance is penetrated into the wood at least essentially deeper than superficially. According to the invention, such a substance used in the method is a complexing agent, e.g., EDTA, which is capable of binding transition metals contained in the wood, whereby the complexing agent is fast impregnated into the wood in a water-based solution, and subsequent to the impregnation step, the complexing agent impregnated into the wood is precipitated from the aqueous phase. The complexing agent can be precipitated by, e.g., lowering the pH of the wood, or alternatively, altering the temperature of the wood after the impregnation step. According to the invention, the complexing agent precipitated into the wood forms a reserve depot, whereby the substance re-dissolving from the depot is capable of binding transition metals entering the wood via rainwater or contamination.

17 Claims, 1 Drawing Sheet

12x

50x

Figure 1:
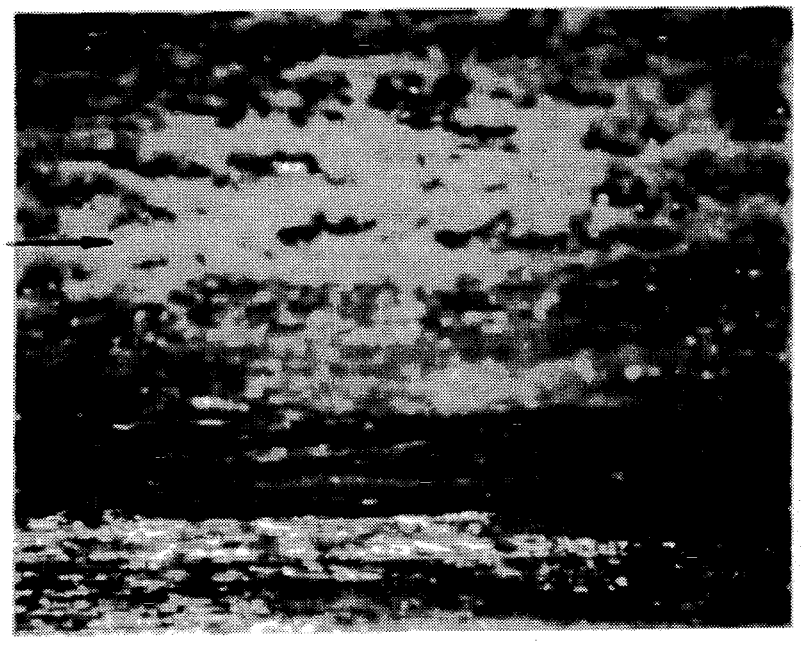

METHOD FOR PRESERVING WOOD AGAINST UNDESIRABLE REACTIONS CAUSED BY MICROORGANISMS

This application is a 371 of PCT/FI94/00127, filed Mar. 31, 1994.

The invention is a method according to the preamble of claim 1 for preserving wood against undesirable reactions caused by microorganisms.

According to such a method, wood is treated with a substance capable of preventing the growth of microorganisms, whereby wood is impregnated at least essentially deeper than superficially with said substance.

The invention also concerns a wood according to the preamble of claim 17, said wood being preserved against undesirable reactions caused by microorganisms.

To preserve wood against decay and damage caused by microorganisms, different types of methods and preserving substances have been developed. The most common method is to impregnate wood as deep as possible with substances capable of preventing growth of microorganisms in wood. Such preserving substances typically are so-called creosote oils which provide at least a satisfactory degree of presentation. A disadvantage of such materials is, however, their general toxicity necessitating the handling of such preservative residues and wood blocks treated with them as hazardous waste.

The prior art also knows approaches in which organic complexing agents or their salts are used to preserve samples of cellulose derivatives against fungal damages caused by *Fungi imperfecti* fungi. For instance, Rao and Kumar [J. Archaelogical Chem. 4 (1986), pp. 11–15] have investigated the inhibitory power of such complexing agents as 8-acetyl-4-methyl umbelliferone (AMU) and dehydroacetate-(3-acetyl-6-methyl-12H-pyran-2,4-(3H)dione (DHA) and copper salts thereof on the hydrolytic effect of enzymes isolated from the *Aspergillus niger* and *Trichoderma viride* mold strains on a sodium carboxymethyl cellulose substrate. The results indicate that in small concentrations the chelating agents have a relatively weak effect as such, while their copper salts achieved 15–25% inhibition effect at concentrations as low as 50 ppm. According to Rao and Kumar, the inhibitory effect exhibited by the chelating agents and particularly their metal salts is based on their reactions with the active groups of enzymes.

It is an object of the present invention to provide an entirely novel method for preserving wood such as sawn wood against undesirable reactions caused by microorganisms.

The invention is based on two basic principles. Firstly, a complexing agent is used as a substance preventing the growth of microorganisms, said agent being capable of binding transition metals contained in wood. Thus, the invention utilizes the fact that through binding iron and other transition metals in wood materials into chelates, an extremely significant inhibitory effect on the growth and spreading of fungi and molds. It has been found that the decay of crystalline cellulose by rot fungi, for instance, takes place via a decay path based on oxidating reactions in which the transition metals contained in wood have a crucial part. Transition metals have a similar role in the growth of molds and blue-stain fungi. Most important of the transition metals contained in wood to the growth of microorganisms are iron (F), particularly trivalent iron, and manganese (Mn).

Complexing agents used for binding transition metals are mostly water-soluble, thus permitting their leaching away from treated wood by rainwater. Therefore, according to the second basic idea of the invention, a solid-phase "reserve depot" of precipitated complexing agent is formed in wood to cater for later entry of metal compounds and moisture into the wood. According to the invention, said reserve depot is provided comprising impregnation of the complexing agent into the wood in the form of an aqueous solution, and after the impregnation step, the complexing agent penetrated into the wood is precipitated from the aqueous phase.

More specifically, the method in accordance with the invention is principally characterized by what is stated in the characterizing part of claim 1.

Furthermore, the wood preserved according to the invention is characterized by what is stated in the characterizing part of claim 17.

The term "undesirable reactions" of microorganisms in the context of the present application is used referring to wood degradation and decay caused principally by fungi and molds. Wood degradation, meaning essential loss of its strength properties, is chiefly effected by rot fungi, of which brown-rot and white-rot fungi deserve mentioning. Further of these, the greatest damages are caused by brown-rot fungi including dry-rot fungus (*Serpula lacrymans*), cellar fungus (*Coniophora puteana*), white-pore fungus (*Poria placenta*) and sauna fungus (*Gloeophyllum trabeum*). Rot fungi decompose structural components of wood, that is, cellulose and hemicellulose by virtue of reactions ending in hydrolytic and oxidizing radical reactions. Conventionally, decay of wood is characterized by the weight loss of the wood.

Damage to wood (that is, color defects) is caused by blue-stain and mold fungi. Also these fungi have been found capable of decomposing cellulose and hemicellulose to some extent (generally resulting in a weight loss not greater than 30%), notwithstanding the relatively low hydrolytic activity of these fungi. Of fungi causing mold damages, strains worth mentioning are those belonging to the Cladosporium, Alternaria, Helminthosporium, Penicillium, Aspergillus, Epicoccus and Rhizopus families. Mold fungi belonging particularly to the Penicillium and Aspergillus families cause extensive damage in indoor spaces and structures.

Blue-stain fungi most frequently found in wood include strains of the Ambrosiella, Aureobasidium, Ceratocystis, Cladosporium and Phialophora families. Most common blue-stain strains attacking sawn pine wood belong to the *Aureobasidium pullulans* and Ceratocystis families, e.g., *C. pilifera.* Besides these strains, blue-stain in spruce wood is caused by, e.g., *Ceratocystis piceae* and *C. coerulescens.* In addition to molds belonging to the above-mentioned strains, strains of the Sclerophoma family occur in sawn pine wood such as *Sclerophoma entoxylina.*

The present invention can be utilized to preserve wood against undesirable reactions of all above-mentioned microorganisms.

In the context of this application text, the term "complexing agent" (or "chelating agent") is used referring to a compound capable of binding di- or trivalent cations into insoluble or soluble complex compounds.

Complexing agents can be divided into inorganic and organic compounds. Inorganic complexers are different kinds of cyclic and linear phosphate compounds, e.g., polyphosphates such as sodium tripolyphosphate ($Na_5P_3O_{10}$, STPP). The most important organic complexers employed are aminopolycarboxyl acids and their salts in which the acid part is formed by acetic acid [examples representing such agents being ethylenediaminetetraacetic acid (EDTA), nitrilotriacetic acid (NTA), n-hydroxyethyl-etylenediaminetriacetic acid (HEDTA), dietylenetriaminepentaacetic acid (DTPA), etylenediamine-di-(o-hydroxyphenylacetic acid (EDDHDA), diethanolglycine (DEG) and ethanolglycine (EDG)], hydroxy acids (gluconic acid, glucoheptonic acid and other sugar acids such as β-glucoisosaccaric acid, α-isosaccaric acid, tartaric acid, malic acid and citric acid) and their salts, as well as organophosphates in which the acid part is formed by phosphoric acid [examples of such acids being aminotrimethylenephosphonic acid (ATMP), 1-hydroxyethylidene-1,1-diphosphonic acid (HEDP), ethylenediaminetetramethylenephosphonic acid (EDTMP), diethylenetriaminepentamethylenephosphonic acid (DTPMP)] and their salts. The invention can also be implemented using metal-binding proteins.

The complexing power of a complexer is assessed by determining its equilibrium constant in the complexing reaction. The higher the value of the equilibrium constant K, the less free metal ions can exist in the presence of the complexing agent. The thermodynamical stability of the formed complex compound, or the complexing power of the complexer, relative to a given metal cation is conventionally described by the logarithm of the equilibrium constant.

Particularly advantageously, the present invention is implemented using an organic chelating agent as the complexer such as, preferredly, aminopolycarboxylic acid or a salt thereof, or an organophosphate such as EDTA, NTA, DTPA and/or HEDTA or a salt thereof.

In the context of the present invention, the term "wood" is used referring to both felled timber (e.g., logs) and sawn wood, as well as wood in service (e.g., wood in constructions). Both deciduous and coniferous wood can be treated. Particularly advantageously, the invention is suited to preserving sawn coniferous wood, typically pine wood, against rot fungi, blue-stain fungi and mold fungi.

The wood preservation method according to the invention can be divided into two steps: impregnation and precipitation.

In the impregnation step, wood is treated with such an effective amount of the complexing agent that achieves at least partial binding of metals occurring natively in wood. Such binding is specifically inflicted on transition metals, particularly iron and manganese, which are essential to the growth and spreading of microorganisms. In the precipitation step, the complexing agent is precipitated from the aqueous phase to the end of forming a reserve depot of solid-phase complexing agent into the wood.

In the impregnation step according to the invention, wood is impregnated preferably as deep as possible using such an aqueous solution in which the effective component is a complexing agent or a mixture of a number of complexing agents. It has been found, however, that already a superficial treatment with a complexing agent is sufficient to at least prevent staining caused by molds. The concentration(s) of the complexing agent(s) can be varied widely in the treating solution. Typically, the concentration is approx. 0.01–50%, advantageously approx. 0.1–30% of solution weight. The amount of complexing agent used for impregnation varies depending on the moisture content and transition metal content in the wood. Typically, the consumption of impregnation solution in pressure treatment is approx. 300–500 l per 1 $m^3$ wood when the moisture content of wood is 20% and the complexing agent concentration in the solution is approx. 25%. Given 1 kg wood being treated with an average density of approx. 500 $kg/m^3$, the impregnation step consumes approx. 0.6–1.0 l of impregnation solution.

The impregnation solution is advantageously water-based, and the wood preservative can also include other conventional additives capable of promoting the entry of the solution into the wood structure. Besides biologically inert additives, the wood preservative according to the invention can contain conventional biologically active compounds such as copper ions or complex compounds of copper. Besides water, the complexing agent can be dissolved in other solvents (e.g., alcohols such as ethanol and methanol) or in aqueous mixtures of such solvents. The proportion of water in such mixtures can be varied in the range 1–99 vol-%. Also different kinds of emulsions are feasible, whereby the complexing agents as well as their possible additives are dissolved in solvents of different phases. Thence, the expression "complexing agent is impregnated into wood in a liquid phase" to be used later covers both the alternative in which the impregnation step is carried out according to a first alternative using a solution or mixture containing the complexing agent in dissolved form in the impregnation step as well as the second alternative in which the impregnation step is carried out using an emulsion, whereby the complexing agent need not necessarily be dissolved in all phases of the emulsion.

According to a preferred embodiment of the invention, the goal is to bind a maximum proportion of transition metals contained in the wood into essentially insoluble form, whereby the transition metals are prevented from contributing to the fungal growth processes. According to another embodiment, transition metals are bound into soluble complex compounds which can at least partially be leached out from the wood. According to the latter embodiment, the wood material can be washed at least partially, for instance from its surface, free from transition metals. It must be noted that with regard to the growth of fungi, the solubility properties of the transition metal complex are nonessential, because the transition metal (particularly iron) even when bound as a soluble complex is also in a form unavailable to the metabolism of fungi.

Metals accumulate in wood continuously along with rainwater, and particularly, through contamination. To obtain a long-term benefit from the chelating agent contained in the wood, the chelating agent is converted into the form of a reserve depot from which chelating agent dissolves into water entering the wood. Such solubility in water is an essential property to the function of the method, because chelating is a liquid phase reaction. Owing to the reasons given above, the amount of the complexing agent impregnated into the wood is provided in excess to that required for binding the transition metals inherently contained in the wood. After the impregnation step, the complexing agent is precipitated from the liquid phase of the solution (precipitation step).

The precipitation of the complexing agent into the wood can be implemented in two different manners, namely by adjusting either the pH or the temperature.

According to the first preferred embodiment of the invention, the complexing agent is precipitated from the aqueous phase by lowering the pH value of the wood after the impregnation step. The pH of the wood is lowered using an inorganic or organic acid or a salt thereof. A mineral acid such as sulfuric, nitric or chloric acid is particularly suitable, or an acid salt thereof. Another advantageous alternative is the use of boric acid, whereby into the wood is introduced boron which acts as, e.g., a fire retardant and preservative against insects. Lowering of pH can also be made using mixtures of the above-mentioned acids, of which mixtures may be particularly mentioned the mixtures of boric acid with mineral acids ,and the mixtures of boric acid salts (particularly borax) with mineral acids.

The chelating agent concentration and the pH levels in the treatment steps must be selected so as to attain chelating of metals contained in the wood and storage of a sufficient reserve depot of precipitated chelating agent in the wood. Moreover, pH in the wood must remain to such a level after the treatment which assures reasonable stability of the problem metal chelates. In this context, the term "problem metal chelates" is used referring to chelates formed by chelating agents with the transition metals contributing to the growth and spreading of microorganisms. For example, when $Na_4EDTA$ is used as the chelating agent, the end pH in wood should preferredly be approx. 5. Though lower pH is possible within the scope of the invention, the result might be a decreased stability of the chelates (owing to competition by the wood material on binding the metals).

Thus, the amount of acid used in the acid treatment step is selected according to the desired end pH. When $Na_4EDTA$ is used as the chelating agent and pH is lowered from 10.5 to 5, each four equivalents of $Na_4EDTA$ require two equivalents of acid. In other words, for 1 mol of $Na_4EDTA$, 2 mols hydrochloric acid or 1 mol sulfuric acid is used. Corresponding amounts of acid are used for $Na_2H_2EDTA$ in order to lower pH from 5 to 2.8.

The acid treatment step can be carried out directly after the impregnation with the complexing agent, or alternatively, the wood can be dried in between. By virtue of intermediate drying steps, the impregnation step can be repeated even several times, thus permitting the storage of a larger reserve depot of the complexing agent in the wood. The intervals between such intermediate drying steps can be shortened through the use of organic solvents or water-based mixtures/emulsions of organic solvents in the impregnation step. If the acid treatment step is carried out without intermediate drying, the volume of the complexing agent solution used in the impregnation step must be reduced by the volume of the acid used in the acid treatment step.

According to the first preferred embodiment of the invention, the complexing agent used for impregnating wood is an aqueous solution of a water-soluble salt. Preferredly, the water-soluble salt is an alkali metal salt of the complexing agent. Most preferredly, $Na_2H_2EDTA$ and/or $Na_4EDTA$ is used.

When the complexing agent used is $Na_4EDTA$, the wood is first treated in clearly alkaline pH with an aqueous solution of the complexing agent, after which the pH in the wood is lowered below pH 5.5 to the end of precipitating the complexing agent into the wood.

According to this embodiment, aqueous solution of $Na_4EDTA$ of adequate concentration is impregnated into the wood at pH 8.5–12, after which acid is impregnated into the wood to lower the pH. In the mixture (EDTA+acid) impregnated into the wood, the desired end concentration range of EDTA is approx. 7–20%, advantageously approx. 7–10%.

This embodiment and the amount of acid required in it can be elucidated by means of the following calculation example: (using an example block of wood with 1 kg mass and 20% moisture content). EDTA is added in the form of $Na_4EDTA$, whereby the solution pH is, e.g., approx. 11.5. The total volume of the EDTA solution and the post-acidification solution is approx. 0.6–1.0 l. The total volume is selected as 0.8 l, of which one half can be of the EDTA solution (with an EDTA concentration of 25% ), while the other half is of the acid solution. Then, the volume of solution remaining in the wood after impregnating will be totally 1 l (comprising 0.4 l EDTA, 0.4 l acid solution and 0.2 l water as moisture content of wood).

After the $Na_4EDTA$ solution is impregnated, acid is impregnated to adjust pH in the wood to approx. pH 5. This is attained by adding 2 mol of monovalent acid (HCl), or correspondingly, 1 mol of divalent acid ($H_2SO_4$), per each mol of EDTA. Alteratively, also boric acid $H_3BO_4$ can be used which theoretically is trivalent, while in practice the hydrolysis of the two remaining hydrogen atoms after the first one is so minimal that boric acid behaves as a weak monovalent acid.

Accordingly, the concentrations of the acid solutions will be:

$c_{HCl}$=4.80 wt-%, or correspondingly $c_{H_2SO_4}$=6.45 wt-%, or $c_{H_3BO_3}$=8.13 wt-%.

The amount of EDTA precipitated in this manner will be multiple with respect to what is required to chelate metals contained in the wood. Then, an ample reserve depot of nondissolved chelating agent remains in the wood.

When $Na_2H_2EDTA$ is used as the complexer, wood is first treated at pH 4.5–6, advantageously at approx. pH 5, by aqueous solution of the complexer, after which the pH in the wood is lowered to less than pH 3 to the end of precipitating the complexer in acid form into the wood. A benefit of this embodiment with respect to the former embodiment is that the reserve depot of the complexer is attained using a smaller amount of EDTA. The embodiment is suited for use in applications not requiring a high strength of the wood.

As the pH falls to 5, the solubility of EDTA decreases to almost a tenth compared with the solubility of $Na_4EDTA$ at pH 10. The solubility of EDTA in acid form in water is 0.03 wt-%, while that of $Na_4EDTA$ is 40 wt-%. The decrease of solubility is caused by the dissociation of weak Na complexes, whereby protons replace sodium. At pH 2.8 the EDTA precipitates in acid form. Lowering pH to such a low value does not, however, cause dissociation of heavy metal chelates including iron(II) and manganese(II) chelates.

Also NTA can be precipitated by adjusting the pH, but as the end pH remains to approx. pH 2.5–3, the stability of the chelates is not as good as those obtained with EDTA. Besides pH, chelate stability is also affected by the chelating agent itself, that is, via its chelating properties.

According to another advantageous embodiment of the invention, a complexing agent is used by impregnating it into the wood in an aqueous solution heated to at least 50° C., after which the precipitation of the complexing agent is effected by lowering the temperature of the wood to less than 30° C. after the impregnation step. Thus, complexing agents of the DTPA and HEDTA type and salts thereof can be advantageously precipitated into the wood by adjusting the temperature.

When desired, both above-described embodiments can be combined so that the complexing agent solution is impregnated into the wood at elevated temperature, after which pH and temperature in the wood are lowered in a preferred manner.

The first step of the method, namely the impregnation of the complexer into the wood, and the second step comprising the acid treatment can be carried out in any conventional fashion employing, e.g., pressure, vacuum and vacuum-pressure impregnation techniques. Regarding the second step, it must be noted that the acid must be impregnated so as to prevent the excess solution of the complexer contained in the wood from escaping from the wood during the acid treatment step. Therefore, the acid treatment step is preferredly carried out using the pressure technique. According to an alternative embodiment, the complexer solution is impregnated into the wood using approx. 10–95%, preferredly approx. 70–90% vacuum (duration of treatment approx. 10 min–5 h, preferredly approx. 30 min–2 h). Next, the excess complexer solution is expelled, which may be first carried out at atmospheric pressure and subsequently at a partial vacuum, after which the pressure is elevated to approx. 2–20 bar (gauge), advantageously to approx. 5–15 bar (gauge), whereby the acid solution is applied to the wood. After the acid treatment step at elevated pressure, the wood may still once be subjected to a post-vacuum treatment to the end of expelling surplus liquid from the wood. The duration of such a step is approx. 1 min–2 h, preferredly approx. 5 min–1 h. A vacuum of approx. 70–90% is used. According to an alternative embodiment, the method is implemented comprising impregnating the complexer solution into the wood at elevated temperature, e.g., approx. 30°–80° C., at elevated pressure (approx. 2–6 bar (gauge), duration of treatment approx. 5 min–1 h). Then, the pressure is elevated to approx. 10–15 bar (gauge) for a duration of approx. 0.5–5 h to improve impregnation. Subsequent to impregnation, the pressure is lowered rapidly, the solution is drained off and the post-vacuum treatment is carded out (using a vacuum of approx. 70–90%), whereby as the evaporation of the solution achieves the precipitation of the complexing agent.

Alternatively, the complexer solution and the acid solution can also be penetrated into the wood by immersion. The latter alternative can be implemented by, e.g., simply immersing the ready-sawn wood first in a tank filled with the complexer solution, after which the wood is transferred to a tank containing the acid solution. In the tank process, a maximally saturated solution of the complexing agent is used, whereby the durations of the complexer and acid treatment steps are approx. 1 min–5 h.

Treatment of green sawn wood in the tank process typically takes approx. 30 min–2 h.

The temperature of the treated wood can be lowered by allowing the wood cool at normal ambient temperature of the treatment plant or outdoors. When desired, the efficacy of the cooling step can be improved by means of cooling equipment.

On the basis of the above-discussed, wood preserved against undesirable reactions by microorganisms contains a complexing agent in solid phase whose re-dissolved form is capable of binding transition :metals contained in the wood. Specifically, such advantageous wood contains precipitated EDTA by approx. 0.01–50% of the wood weight. Frequently, at least a portion of the EDTA is in crystalline form.

The invention provides significant benefits. Accordingly, impregnating wood in accordance with the invention using complexing agents capable of binding transition metals, particularly trivalent iron and manganese, a significant preserving effect against the growth of molds and fungi listed above can be attained. The wood preservative according to the invention is water-soluble and thus safe to the environment. Further, the preservative does not contain any substances of general toxicity, but rather is particularly specific to such microorganisms occurring in wood that cause undesirable reactions. By forming a reserve depot into the wood, the effect of the complexing agents can be extended in optimum cases up to cover the entire service life of the wood.

In the following, the invention is examined with the help of a few application examples.

Figure 2:
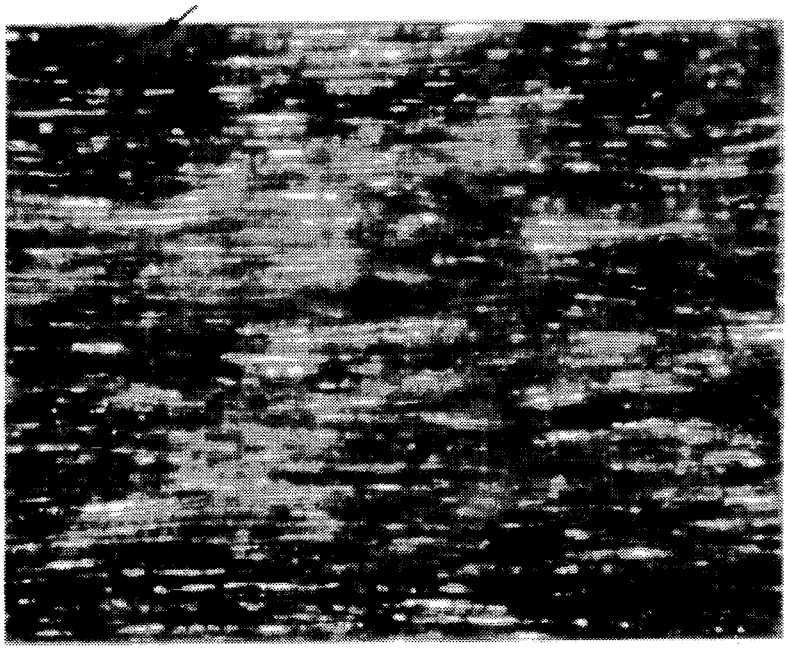

Annexed FIGS. 1 and 2 show light-microscopic pictures taken from wood treated according to the invention, wherein FIG. 1 is a 12× magnification of the picture taken from the sample, and FIG. 2 is a 50× magnification of the picture taken from the sample.

EXAMPLE 1

Precipitation test

The goal of this test was to verify the precipitation of EDTA in intended preservation conditions.

An 11 ml aliquot of 22.6 wt-% $Na_4EDTA$ solution was prepared in a beaker. 5.98 ml of 2 mol HCl solution was added. Then, the concentration of EDTA in the solution was 14.6% and the solution pH was approx. 4. Precipitation of EDTA was found to begin about half an hour after the start of the acid treatment step.

EXAMPLE 2

Effect of wood itself on pH values in different treatment steps

The goal of this test was to assess the effect of the wood material itself on the pH levels in the different steps of the preservation process.

An 11 g aliquot dry wood shavings was weighed into a beaker and 13.5 g of 7.5% $Na_4EDTA$ solution was added. Then, the quantities of materials were proportionately comparable to those used in full-scale impregnation. The mixture was homogenized through careful mixing. Wet shavings were measured to have pH 9.6, which is sufficiently high for assuring solubility of $Na_4EDTA$ in the treatment step with EDTA.

Change of pH during the acid treatment step was examined in similar conditions. Again, an 11 g aliquot dry wood shavings was weighed into a beaker. Next, 6.75 g of 15% $Na_4EDTA$ solution, 5.33 ml of 1 mol HCl solution, and 1.42 ml water purified with an ion exchanger were added. Then, the ,concentration of EDTA in the solution was determined as 7.5%. After careful mixing, the pH of the wet shavings was measured and found to be slightly less than 4, which is a proper pH level for achieving the precipitation of EDTA.

EXAMPLE 3

Impregnation efficacy test

The wood block used in this impregnation efficacy test was pine board sawn from sapwood. The concentration of the $Na_4EDTA$ solution was chosen relatively high (20%) for the test to facilitate easier detection of the precipitation of EDTA. The wood block being impregnated was dried at 104° C. overnight, after which the dry weight of the block was measured as 60.92 g. Before the impregnation was commenced, the wood block had reabsorbed some moisture, so the block weight had increased to 61.75 g. Air was extracted from the wood block already immersed in the EDTA solution for 0.5 h by a vacuum at −720 mmHg below atmospheric pressure, after which the vacuum was removed and the EDTA solution was allowed to penetrate into the wood at atmospheric pressure for 2 h. After the impregnation step, the wood block weight was measured as 181.40 g, of which the contribution of the EDTA solution was 119.65 g. The wood block was dried, after which air was again removed for 0.5 h from the block immersed in 1.5 mol HCl solution by a vacuum at −720 mmHg below atmospheric pressure. The vacuum was removed and approx. 84 ml HCl solution was allowed to enter the wood, whereby the moisture content of the wood became approx. 57% of the total weight of the wood and contained water. The wood was allowed to stay overnight in an air-tight plastic bag to prevent loss of moisture content through evaporation.

Samples from inside the wood were taken by sectioning the wood into pieces. While the visual inspection of the sample pieces already revealed precipitation patches of EDTA, further investigations with light-microscopy revealed that also places not showing visually detectable precipitations contained precipitations in scattered locations. The precipitations are seen in FIGS. 1 and 2 as light-grey pricks and patches.

EXAMPLE 4

Impregnation efficacy test

The wood block to be impregnated was of the same wood as that of Example 3. The form of EDTA employed in the test was $Na_2H_2EDTA$, which was prepared into a 5% solution (pH in solution approx. 5). The wood block being impregnated was dried in the same manner as in Example 3, and the weight of the dried wood block was 61.85 g. Before the impregnation was commenced, the wood block had reabsorbed some moisture, so the block weight had increased to 62.69 g. EDTA was impregnated into the wood in the same manner as in Example 3.

After the impregnation step, the wood block weight was measured as 172.48 g, of which the contribution of the EDTA solution was 109.79 g. The wood block was dried, after which air was removed for 0.5 h from the block immersed in 0.4 mol HCl solution by a vacuum at −720 mmHg below atmospheric pressure. The vacuum was removed and approx. 82 ml HCl solution was allowed to enter the wood, whereby the moisture content of the wood became approx. 57% of the total weight of the wood and contained water. The wood was allowed to stay overnight in an airtight plastic bag to prevent loss of moisture content through evaporation. Precipitations were detected in the same fashion as in Example 3.

EXAMPLE 5

Wood preserving efficacy test

Three rot fungi were selected for this test that occur most frequently in Finland and cause the greatest damages: cellar fungus (*Coniophora putana*), white-pore fungus (*Poria placenta*) and sauna fungus (*Gloeophyllum trabeum*).

The substrates for this test, which were sapwood pieces cut from pine, were treated in the same manner as in Examples 3 and 4 by the method according to the invention except that the method of Example 3 was carded out having the concentration of EDTA adjusted to 10%. The dimensions of the test pieces were 5×15×30 mm.

Some of the test pieces were impregnated using the comparative CC preservative as 0.4% and 1.6% solutions. The composition of the comparative preservative was:

| | |
|---|---|
| $CuSO_4.5H_2O$ | 50.0% |
| $K_2Cr_2O_7$ | 48.0% |
| $CrO_3$ | 2.0% |

Subsequent to the impregnation steps, the test pieces were dried cautiously at a lowered temperature, after which they were rinsed for 3 days with distilled water acidified to pH 4.5–5.0. During rinsing, the test pieces were entirely submerged in the distilled water, thus assuring effective rinsing. The rinsing water was replaced at sufficiently frequent intervals to avoid accumulation of EDTA in the water. Additionally, unrinsed test pieces were picked aside from each treatment step. Subsequent to rinsing, the test pieces were allowed to dry in room conditions for 2 weeks, after which they were sterilized by irradiation. The radiation source was $Co^{60}$.

The test pieces were inserted in kolle dishes filled with an 1% aqueous solution of agar-agar so that 3 impregnated test pieces and 3 nonimpregnated comparative test pieces were placed in each dish. The fungus to be tested was grafted on an agar-agar lump resting on the test piece. The number of parallel dishes was 2. The rot test was perform according to a modified EN 113 method in which the rot time was 10 weeks. After this period, the kolle dishes were opened and the weight losses of the test pieces were determined.

All unrinsed EDTA treatments were effective against the test strains of rot molds. The weight losses were maximally only 1.7%, while in the comparative samples the weight losses were in the order of approx. 23–25%.

Also in the rinsed test pieces the weight losses were insignificant (a weight loss less than 2% can be regarded equal to zero in practice as minor amounts of substances contained in the wood will anyhow dissolve from the wood to the agar-agar substrate even in the absence of a rot process). Only the mold *Poria placenta* was found to cause small loss of weight. The weight losses detected in the rot tests are given in the table below.

| | Weight loss [%] | | | | | | | | |
|---|---|---|---|---|---|---|---|---|---|
| | *Coniophora puteana* | | | *Poria placenta* | | | *Gloeophyllum trabeum* | | |
| | Rinsing [d] | | Comparative | Rinsing [d] | | Comparative | Rinsing [d] | | Comparative |
| Preservative | 0 | 3 | sample | 0 | 3 | sample | 0 | 3 | sample |
| 10% $Na_4EDTA$ | 1.7 | 2.2 | 23.9 | 1.3 | 6.5 | 24.7 | 1.2 | 0.4 | 25.3 |
| 5% $Na_2H_2EDTA$ | 1.4 | 4.0 | 23.0 | 0.2 | 8.7 | 23.7 | 0.2 | 1.0 | 25.4 |
| 0.4% CC (comp. preserv.) | 0.1 | 0.4 | 21.1 | 3.3 | 5.6 | 20.3 | 0.4 | 0.5 | 24.7 |
| 1.6% CC (comp. preserv.) | 0 | 0 | 22.5 | 0 | 0.4 | 20.3 | 0 | 0 | 24.3 |

According to the measured weight losses, the precipitation of the EDTA into the wood by virtue of lowering the pH provides significant improvement of the rot preservation efficacy. For comparison it can be noted that rotting of test pieces, which were treated with $Na_4EDTA$ but not subjected to precipitation, was after rinsing almost as severe as that of the comparative test pieces, although protective efficacy of preservation against rot in the unrinsed samples was good. Accordingly, the weight loss of a rinsed test piece grafted with *Coniophora puteana* was 16.7%, while the weight loss of an unrinsed test piece was only 0.5%. Corresponding figures for test pieces grafted with *Poria placenta* and *Gloeophyllum trabeum* were 23.0%/2.4% and 16.1%/5.0%.

Thus, the precipitation method has been proven to provide efficient prevention against leaching of EDTA in humid conditions, thereby improving rot prevention efficacy.

We claim:

1. A method for preserving wood against undesirable reactions caused by micro-organisms, which comprises:

treating wood with a wood preservative in the form of a liquid phase which includes at least one complexing agent whereby said wood preservative penetrates said wood and renders transition metals contained in said wood unavailable for metabolism by said micro-organisms; and precipitating said complexing agent within said wood from said wood preservative which has penetrated said wood.

2. The method of claim 1, wherein said liquid phase is a water-based solution.

3. The method of claim 1, wherein said complexing agent is precipitated from said wood preservative in an amount greater than is necessary to bind transition metals contained in said wood.

4. The method of claim 1, wherein said complexing agent is selected from the group consisting of an inorganic phosphate compound, an aminopolycarboxyl acid, a salt of an aminopolycarboxyl acid, a hydroxy acid, a salt of a hydroxy acid, an organophosphate, a salt of an organophosphate and a metal-binding protein.

5. The method of claim 4, wherein said aminopolycarboxyl acid is selected from the group consisting of ethylenediaminetetraacetic acid (EDTA), nitrilotriacetic acid (NTA), n-hydroxyethyl-ethylenediaminetriacetic acid (HEDTA) and diethylenetriaminepentaacetic acid (DTPA).

6. The method of claim 1, wherein precipitating said complexing agent within said wood is accomplished by lowering the pH of said wood.

7. The method of claim 6, wherein lowering the pH of said wood is accomplished by using an acid selected from the group consisting of a mineral acid, a boric acid and mixtures thereof.

8. The method of claim 6, wherein lowering the pH of said wood is accomplished by using an acid salt selected from the group consisting of a mineral acid salt, a boric acid salt and mixtures thereof.

9. The method of claim 6, which further comprises drying said wood prior to lowering the pH.

10. The method of claim 1, wherein said wood preservative is in the form of a water-based solution of a water soluble salt of said complexing agent.

11. The method of claim 10, wherein said water-soluble salt is an alkali metal salt of said complexing agent.

12. The method of claim 11, wherein said alkali metal salt of said complexing agent is selected from the group consisting of $Na_2H_2EDTA$, $Na_4EDTA$ and mixtures thereof.

13. The method of claim 12, which further includes:

treating said wood with said wood preservative being in the form of a water-based solution which includes at least $Na_2H_2EDTA$ as said complexing agent, at a pH of 4.5–6; and precipitating said complexing agent within said wood by lowering the pH level of said wood below pH 3.

14. The method of claim 12, which further includes:

treating said wood with said wood preservative being in the form of a water-based solution which includes at least $Na_4EDTA$ as said complexing agent, at an alkaline pH; and precipitating said complexing agent within said wood by lowering the pH level of said wood below pH 5.5.

15. The method of claim 2, which further includes:

treating said wood with said wood preservative being in the form of said water-based solution which includes at least one organic compound as said complexing agent, at a temperature of at least about 50° C.; and precipitating said complexing agent within said wood by lowering the temperature of said wood below about 30° C.

16. The method of claim 2, which further includes:

treating said wood with said wood preservative being in the form of said water-based solution which includes at least one organic compound as said complexing agent, at a temperature and pH sufficient to maintain the solubility of said complexing agent in said water-based solution; and precipitating said complexing agent within said wood by lowering the temperature and pH of said wood.

17. The method of claim 1, wherein said wood is preserved against undesirable reaction caused by micro-organisms including molds, blue-stain fungi and rot fungi.

* * * * *

UNITED STATES PATENT AND TRADEMARK OFFICE

CERTIFICATE OF CORRECTION

PATENT NO. : 5,582,871
DATED : December 10, 1996
INVENTOR(S) : Silenius et al.

It is certified that error appears in the above-indentified patent and that said Letters Patent is hereby corrected as shown below:

IN THE TITLE PAGE:

| | |
|---|---|
| In Heading [73] for Assignee, | now reads "**Kymmene Oy**, Helsinki, Finland" should read, --**Kymmene Oy,** Helsinki; **Koskisen Oy**, Järvelä; **Metsäliitto Osuuskunta**, Espoo, all of Finland--. |

Signed and Sealed this

Thirtieth Day of September, 1997

*Attest:*

Bruce Lehman

BRUCE LEHMAN

*Attesting Officer*

*Commissioner of Patents and Trademarks*